United States Patent [19]

Robbart

[11] 4,339,479

[45] * Jul. 13, 1982

[54] TREATMENT OF CELLULOSE

[76] Inventor: Edward Robbart, 321 Fairmount Ave., Milton, Mass. 02186

[ * ] Notice: The portion of the term of this patent subsequent to Dec. 24, 1991, has been disclaimed.

[21] Appl. No.: 534,807

[22] Filed: Dec. 20, 1974

Related U.S. Application Data

[63] Continuation-in-part of Ser. No. 308,057, Nov. 20, 1972, abandoned, which is a continuation-in-part of Ser. No. 39,538, May 21, 1970, abandoned, which is a continuation-in-part of Ser. No. 522,366, Jan. 24, 1966, abandoned, which is a continuation-in-part of Ser. No. 386,622, Aug. 8, 1973, Pat. No. 3,856,558.

[51] Int. Cl.[3] ..... C23C 11/00

[52] U.S. Cl. ..... 427/255.1; 427/255.6; 427/296; 427/316; 427/324; 427/326; 427/391; 427/392

[58] Field of Search ..... 427/248.1, 316, 324, 427/326, 296, 391, 392, 255.1, 255.6

[56] References Cited

U.S. PATENT DOCUMENTS

| | | | |
|---|---|---|---|
| 2,306,222 | 12/1942 | Patnode | 427/248 |
| 2,386,259 | 10/1945 | Norton | 427/248 |
| 2,412,470 | 12/1946 | Norton | 427/248 |
| 2,782,090 | 2/1957 | Robbart | 8/116 |
| 2,961,338 | 11/1960 | Robbart | 427/248 |
| 2,995,470 | 8/1961 | Robbart | 427/248 |
| 3,676,182 | 7/1972 | Smith | 427/316 |
| 3,837,804 | 9/1974 | Walker et al. | 427/248 X |
| 3,856,558 | 12/1974 | Robbart | 427/248 H |

FOREIGN PATENT DOCUMENTS

| | | | |
|---|---|---|---|
| 116470 | 1/1943 | Australia | 427/248 |

*Primary Examiner*—Norman Morgenstern
*Assistant Examiner*—S. L. Childs
*Attorney, Agent, or Firm*—Larson and Taylor

[57] ABSTRACT

A process for rendering cellulosic material water repellent that requires no subsequent neutralization step while retaining the desired water repellent and strength characteristics thus provided by selecting a cellulosic material having a water content of up to about 10%, preferably below about 2% and contacting the material with vapors of a lower alkyl silicon halide during which contacting the concentration and temperature of the halide vapor, the pressure within the treating chamber and the contact time are all maintained so as to provide a water repellent cellulosic material having a pH greater than 2.5. In one aspect of the invention, the cellulosic material subjecting to contacting is substantially frozen and in another aspect contacting is conducted under vacuum.

24 Claims, No Drawings

TREATMENT OF CELLULOSE

This application is a continuation-in-part of application Ser. No. 308,057, filed Nov. 20, 1972 (now abandoned) which in turn is a continuation-in-part of application Ser. No. 39,538, filed May 21, 1970 (now abandoned) which in turn is a continuation-in-part of Ser. No. 522,366, filed Jan. 24, 1966 (now abandoned) which in turn in a continuation-in-part of Ser. No. 386,622 filed Aug. 8, 1973 now U.S. Pat. No. 3,856,558.

BACKGROUND OF THE INVENTION

This invention relates to the treatment of cellulosic materials, such as paper, with an organo silicon halide to impart water repellency and other desirable properties to the treated material.

It has long been known that material treated with organo silicon halides may be rendered water repellent, apparently through the formation of a siloxane deposit which is formed by a reaction between the halide and adsorbed surface moisture and/or hydroxyl or other reactive groups. In the treatment, hydrogen halide is generated as a reaction by-product. It is also known that paper, cloth and related materials may be made adhesive, or given "release" or non-sticking properties, by treatment with organo silicone reagents in such a way as to produce a silicon-containing layer on the surface of the material. This treatment may also produce hydrogen halide as a by-product.

In these prior art treatments, the cellulosic material has been contacted with the organo silicon halide either in liquid or vapor form. However, the conditions under which these prior art treatments have been conducted require that the treated cellulosic material be further treated to neutralize the hydrogen halide by-product formed by the reaction of the organo silicon halide with water or hydroxyl groups. Heretofore, the treatment of cellulosic materials to obtain these and other possible benefits has required that the treated material be neutralized immediately after exposure to the organo silicon halide by immersion in an aqueous alkaline medium. Consequently it has not been practical to treat material such a as paper with an organo silicon halide because of its unsuitability to a subsequent neutralization step in an aqueous medium. The suggestion has been made to neutralize the hydrogen halide by means of an ammonia atmosphere, but this results only in the formation of ammonium chloride which is itself acidic and causes degradation of the cellulose. Other processes for waterproofing paper are of course available, but none offers the ease and economy of a simple treatment of exposing the paper to a treating atmosphere. Accordingly, it would be highly desirable to provide a process for rendering cellulosic materials, particularly paper, water repellent with an organo silicon halide while retaining the strength characteristics of the paper and while eliminating the need for a subsequent treating step whereby the hydrogen halide is neutralized.

SUMMARY OF THE INVENTION

In accordance with the present invention a cellulosic material, such as paper, can be rendered water repellent while retaining the strength characteristics of the material and eliminating the need for a subsequent neutralization step by contacting a cellulosic material having a moisture content below about 10 weight percent with vapors of a lower alkyl silicon halide which reacts with hydroxyl groups to form a siloxane, maintaining the cellulosic material and lower alkyl silicon halide in contact for a time sufficient to effect said siloxane formation, the concentration of lower alkyl silicon halide in the contacting atmosphere and the temperature, pressure and contact or exposure time at which said contacting is conducted being maintained so that the cellulosic material contacted with the lower alkyl silicon halide is rendered water repellent and has a pH greater than 2.5. Thus, it has surprisingly been found that under certain conditions organo lower alkyl silicone halide vapors will react with cellulose to render it water repellent without lowering the pH to below 2.5, and preferably not below 3.5. It has been found that the final pH of the cellulosic material is a function of the contact time, moisture content of the paper, the temperature of the paper, the temperature of the vapor, the concentration of the vapor and the pressure within the treating chamber. When the contacting step is conducted with regard to each of these conditions and without appropriate selection and maintenance thereof the resultant product, if not neutralized, will have a pH below about 2.5 and that the acid present in the cellulosic material at these low pHs will degrade it. Of course the final pH of the paper prior to contact with organo silicon halide is depedant upon the initial pH of the paper prior to contact with the organo silicon halide. It is preferred that the conditions selected and maintained during the contact step is such as to form a product which has a pH above about 3.5 in order to retain substantially all the strength characteristics and color characteristics of the final cellulosic material. It is to be understood that the contacting step can be conducted so that the organo silicon halide contacts either one or all surfaces of the cellulosic material. In a preferred embodiment, the organo silicon halide vapor is mixed with a solvent for the organo silicon halide in vapor form and/or the cellulosic material obtained from the organo silicon halide contacting step is treated immediately to remove gaseous hydrogen halide such as by heating the treated cellulosic material or by contacting the treated cellulosic material with a moving gas stream.

In one aspect of the invention, cellulosic materials are rendered water repellent while retaining the strength characteristics of the material and eliminating the need for a subsequent neutralization by treating the cellulosic material with organo lower alkyl silanes as aforementioned but utilizing a cellulose material whose water content of below 2% down to 0% water content. Heretofore, it has always been thought necessary that at least 2 weight percent moisture be present in the cellulosic material in order to effect the reaction therewith with the organo silicon halide to form the siloxane deposit. Copending application Ser. No. 386,622 filed Aug. 8, 1973, for instance, describes a process whereby cellulosic materials are rendered water repellent by contact with organo silicon halide vapors without adversely effecting their strength and which eliminates the subsequent neutralization step that normally characterizes the prior art process by controlling the moisture of the cellulosic material being contacted to at least 2 to up to 7 weight percent and the contact time within about 0.1 to 8 seconds. It has now been discovered that the moisture content of the cellulosic materials contacted with the organo lower alkyl halides used not be at least 2 weight percent, that is, it can be below 2 weight percent, even "bone dry", provided that sufficient contact time is permitted between organo lower alkyl silicon halide vapor and the cellulosic material. It is believed that in this aspect of the invention the necessary siloxane deposit is being effected, at least in large part, by reaction of the organo lower alkyl silicon halide vapors with hydroxyl groups of the cellulosic material. The advantages that this aspect of the invention offers is that it renders unnecessary burdensome moisture controls. In addition one need not be concerned about exceeding the upper contact time period of about 8 seconds to which the process of the copending application is limited since it has been found that with say "bone dry" cellulosic materials contact times of up to 10 minutes can be utilized without excessive HCl by product deposition and the degradation that accompanies it.

Another aspect of the present invention involves bringing the cellulosic material to a temperature below ambient time prior to contacting with the organo lower alkyl halide vapor as aforementioned. In other words the cellulosic material is first placed in a cold or even frozen state prior to contact with the organo lower alkyl silicon halide vapor. It was surprising to find that the siloxane deposition necessary for water repellency actually was obtained while the cellulosic material was in the cold or even frozen state. The advantages offered by this aspect of the invention are that not only is water repellency achieved without the need of a subsequent neutralization step and without loss in product strength but it also permits a lengthening of exposure times substantially beyond the 8 seconds specified by the process of the copending application. Another advantage of this aspect of the invention is that it permits the use of cellulosic materials with a moisture content in excess of about 7 weight percent. Ordinarily with cellulosic materials having moisture contents in excess of 7 weight percent the hydrogen halide gaseous by-product of the reaction will become dissolved in that water thereby forming an acidic solution of the hydrogen halide which reacts with the cellulosic material and degrades it by discoloration and by seriously reducing its strength characteristics.

Yet a third aspect of the invention involves conducting the contacting of the cellulosic materials with the organo lower alkyl silicon halide vapors under subatmospheric conditions such as under vacuum. Again it has been found that the desired siloxane formation can be obtained with the consequent water-repellency without adversely affecting product strength and without the need of subsequent neutralization yet with the added advantages of exposure times extended substantially beyond those of the about 8 seconds maximum required by the process of the copending application Ser. No. 386,622.

DETAILED DESCRIPTION OF THE INVENTION

The cellulosic material contacted with the organo silicon halide should have a moisture content of below about 10 weight percent. Cellulosic materials having moisture contents in excess of 10 weight percent are unsuitable since they will dissolve excessive amounts of hydrogen halide even if the paper is frozen before contact with the organo silicon halide. A moisture content of up to about 7 weight percent in the cellulosic is preferred in those instances wherein the cellulosic material is not contacted in its cold or frozen state. As aforementioned the greatest advantage in first freezing or otherwise rendering "cold" the cellulosic material to be treated is in those cases where the moisture content of the cellulosic material falls in the range of about 7 to 10 weight percent.

The contact time of the cellulosic material and the organo silicon halide is in all cases sufficient to effect said siloxane formation and will vary depending upon the temperature of the cellulosic material and organo silicon halide vapor, the concentration of the organo silicon halide in the contacting atmosphere, the pressure within the treating chamber and the moisture content of the cellulosic material. Contact time ranging from 0.1 second up to 30 minutes have been utilized successfully.

The temperature of the organo silicon halide is sufficiently high to effect reaction between the organo silicon halide and the water and/or groups of the cellulosic material to form siloxane but not so high as to either degrade the cellulosic material by carbonization or to effect excessive hydrogen halide at the contact times employed. Suitable temperatures range from ambient room temperature to about 180° F.

Generally, when employing higher temperatures, shorter contact times are employed and conversely, when employing relatively low temperatures, longer contact times can be employed. Furthermore, the concentration of the organo silicon halide in the atmosphere through which the cellulosic material is passed can be varied up to the saturation level of the atmosphere for the organo silicon halide and, if employed, a solvent for the organo silicon halide. The concentration of the organo silicon halide can range up to the saturation level of the atmosphere but should not be so low as to require excessive contact times in order to effect the desired reaction and to render the cellulosic material material water repellent. Typically, the concentration of the organo silicon halide ranges from about ½ volume percent up to the saturation level of the atmosphere within the contact chamber.

The pressure in the contact chamber under which the contacting can be conducted can be either atmospheric, subatmospheric or an elevated pressure. It can vary widely say from about 1 Torr up to about 16.7 psi or more. Pressures beyond 16.7 psi can be used but are usually unnecessary. In general the higher the pressure within the contacting chamber the lower the contact time and conversely the lower the pressure the higher the contact time necessary to provide the desired water-repellency.

When a cellulosic material having a moisture content of below 2 weight percent is employed pursuant to one aspect of the present invention the contact time must generally be in excess of about 7 seconds and the variables of organo silicon halide vapor temperature, concentration, and the contact chamber pressure are maintained so that the final pH of the cellulosic material rendered water repellent does not fall below 2.5, preferably below 3.5. The range of conditions which will ordinarily be employed will fall in the following ranges:

Temperature of organo silicon halide: ambient to 150° F.
Temperature of cellulosic material: frozen to ambient
Concentration of organo silicon halide: 4% to saturation
Pressure within contact chamber: 3 Torr to atmosphere When the cellulosic material is placed in a cold or frozen condition before contacting, pursuant to another aspect of the invention, the reaction conditions will generally fall within the following ranges:

Temperature of organo silicon halide: ambient to 150° F.
Concentration of organo silicon halide: ½ vol % to saturation
Pressure within contact chamber: Torr 3 to atmosphere
Moisture content: 0 to 10%
Contact time: 0.1 to 30 seconds The specific conditions selected will also depend on the particular "cold" temperature of the cellulosic material. By the term "cold" as used in this specification is meant a temperature below ambient temperature down to minus 345° F. and includes frozen cellulosic materials, that is, cellulosic material whose water content has frozen. Again within ranges set forth, conditions are selected and maintained so that the final pH of the cellulosic material does not fall below 2.5.

The aspect of the present invention involving conducting the contacting under subatmospheric pressure will generally employ the following contacting conditions:

Temperature of organo silicon halide: ambient to 150° F.
Temperature of cellulosic material: frozen to ambient
Concentration of organo silicon halide: ½ vol % to saturation
Contact time: 1 to 10 min.
Moisture content: 0 to 10%

The desired subatmospheric pressure can be simply achieved by imposing a vacuum on the contacting chamber. The preferred subatmospheric pressures are about 2 to 6 Torr.

Again within the ranges set forth conditions are selected and maintained so that the final pH of the cellulosic material does not fall below 2.5.

The suitable organo silicon halides useful in this process are those commonly employed in water repellency treatments for cellulosic materials, such as those described by Patnode in U.S. Pat. No. 2,306,222, Norton, U.S. Pat. No. 2,412,470, and in my earlier U.S. Pat. Nos. 2,782,090; 2,824,778 and 2,961,338 which are incorporated herein by reference. Particularly suitable organo silicon halides are the lower alkyl silicon halides such as methylchlorosilanes, ethylchlorosilanes, butylchlorosilanes and propylchlorosilanes.

Typically, however the silicon halides will be a mixture of dimethyldichlorosilane, $(CH_3)_2SiCl_2$; methyldichlorosilane, $CH_3SiHCl_2$; and methyltrichlorosilane, $CH_3SiCl_3$ which may contain silicon tetrachloride, $SiCl_4$. The trihalogenated organo silicon halides provide more reactive cites for forming the siloxane but also evolve more hydrogen halide per mole of organo silicon halide during the reaction as compared with dihalogenated or monohalogenated organo silicon halides. Thus, generally, the conditions under which the reaction is conducted are less severe when employing relatively highly halogenated organo silicon halides having relatively low halogen substitution so that the pH of the treated cellulosic material is maintained above about 2.5.

In a preferred embodiment of this invention, the cellulosic material is contacted with the vaporized organo silicon halide and a vaporized solvent for the organo silicon halide which solvent is inert both to the organo silicon halide and the paper being treated. It has been found that the presence of the solvent during the treatment step results in the formation of a treated cellulosic material having a higher pH as compared with a cellulosic material which is treated with the same organo silicon halide without the solvent under equivalent reaction conditions. Representative suitable solvents include toluene, xylene, hexane, perchloroethylene, fluorinated hydrocarbons, or other non-reactive solvents in which the organo silicon halide may be dissolved. It has been found that as little as 10 mole percent solvent is effective but that larger concentrations of the solvents in the range of about 12 to 100 mole percent based upon the total mole of the organo silicon halide and solvent are preferred. A molar quantity ten times or more that of the organo silicon halide is effective. If desired, higher concentrations of the solvent can be employed. However, the presence of excessive concentrations of solvent effects a reduction of reaction rate and increases the expense of the solvent without a significant beneficial effect.

The organo silicon halide or the mixtures of vapors organo silicon halide in solvent may be formed by bubbling air through the liquid organo silicon halide and solvent or more simply by dropping the liquid of the desired composition slowly onto a hot plate to generate vapors of the same molar composition as the liquid. Alternatively, an aerosol mixture may be employed as described in my U.S. Pat. No. 2,824,778 which is incorporated herein by reference. When employing a solvent having a significantly different vapor pressure than the organo silicon halide and when effecting vaporization by bubbling air, it is preferred that the solvent and organo silicone halide be maintained as separate liquids in order to better control the composition of the vapors formed in the treating chamber.

The air to be mixed with the organo silicon halide in the treatment step should contain as little water as possible to avoid significant reaction of water in the air with the organo silicon halide which results in the formation of hydrogen halide and reduction of the amount of organo silicon halide that can react with the cellulosic material.

If the moisture content of the cellulosic material to be treated is greater than about 10 weight percent, a drying step prior to the treatment with organo silicon halide is employed. The drying step need only be conducted at a temperature and a time sufficient to remove part of the surface moisture from the material while retaining at least about 2 weight percent moisture in the material. Heating to about 250° F. for from about 3 to 5 seconds is sufficient in most cases. The desirability or necessity of this step will depend upon such factors as the prevailing humidity on the day of treatment, the uptake of moisture by the material during manufacture and storage and the conditions of treatment.

In a second preferred embodiment, the cellulosic material treated with organo silicon halide, either in the presence of or in the absence of a solvent, is further treated, upon removal from the organo silicon halide treating step, to remove hydrogen halide gas formed as by product of the reaction prior to a substantial portion of it becoming dissolved by moisture in the cellulosic material. Generally, the hydrogen halide gas removal can be effected by heating the treated cellulosic material to a relative high temperature in the order of about 200° to 275° F. such as by passing the paper through an oven or oven heated rolls, and/or by passing the treated cellulosic material in contact with a dry moving gas stream such as air.

The process of the invention is applicable to cellulosic materials generally and includes materials such as paper, wood, cotton, textile and sheet material of same, and the like.

The following examples illustrate the present invention and are not intended to limit the same.

EXAMPLE I

A sheet of bleached Kraft paper having a moisture content of 9% by weight was placed under a tray into which liquid nitrogen was poured. The paper remained under the tray until the water contained in the paper was frozen. The tray was then removed and the frozen sheet exposed at atmospheric pressure to a saturated atmosphere of the vapors of a mixture of 70 weight percent methyltrichlorosilane, 20 weight percent dimethyldichlorosilane, and 10 weight percent methyldichlorosilane at room temperature (72° F.) for 5 seconds. The paper was then removed from the saturated silane atmosphere and fresh air (not dried) was blown on the sheet. A portion of the treated sheet was placed in an oven at 300° F., for 60 seconds and then removed. The paper was not embrittled or discolored and was highly water repellent.

EXAMPLE II

A sheet of bleached Kraft paper having a moisture content of 9% by weight was placed inside of a metallic tray which was placed on top of a cake of dry ice. A small glass plate was placed over a section of the sheet to ensure contact with the cold surface and to prevent adsorption of moisture on to the paper since the enclosed metallic tray contained air that was not dried (relative humidity was 60% air temperature 72° F.). A saturated atmosphere of vapors of the mixture of methylchlorosilanes of Example I at room temperature was poured into the tray and the glass plate removed. After 5 seconds, the sheet was removed from the saturated silane atmosphere and fresh air (not dried) was blown across its surface. The sheet was then placed in an oven at 300° F. for 60 seconds. The paper was discolored and embrittled except for the area which was covered by the glass plate enabling the entire water content of the area to be frozen. The covered area in which the water was frozen was neither discolored nor embrittled. The entire surface of the sheet was highly water repellent.

EXAMPLE III

A sheet of bleached supercalendered Kraft was made "bone dry", i.e. no removable moisture remained, by placing the sheet in an oven whose temperature was 105° C. until weight loss, resulting from removal of moisture in the paper, stopped. The "bone dry" sheet was placed in a sealed contained into which a saturated atmosphere of the mixture of methylchlorosilanes of Example I at room temperature was introduced. The sheet was exposed to the vapors of the silanes at atmospheric pressure for up to 10 minutes and then removed from the saturated atmosphere. Fresh air (not dried) was blown against the surface of the paper. There was no odor of HCl. The sheet was then placed in an oven at 300° F. for 60 seconds. The treated sheet was not discolored or embrittled. The paper was highly water repellent.

EXAMPLE IV

The same procedure was used as in Example III except that the paper was removed from the saturated silane atmosphere and placed directly in the oven at 300° F. for 60 seconds. There was no odor of HCl. The sheet was not discolored or embrittled. The sheet was highly water repellent.

EXAMPLE V

The same procedure as Example III was used except that the material was a piece of white cotton percale. There was no degradation and the cotton was highly water repellent.

EXAMPLE VI

The same procedure as Example IV was used except that the treated material was cotton percale. There was no degradation and the cotton was highly water repellent.

EXAMPLE VII

The same procedure as Example III was used except that the treated material was white cotton percale and the exposure time to the silane vapors was 30 minutes. Fresh air (not dried) was blown against the sheet. There was no odor of HCl. The material was placed in an oven for 60 seconds at 300° F. The material was not discolored. The material was highly water repellent. The material was somewhat weakened.

EXAMPLE VIII

The same procedure as in Example VI was followed except that the exposure time to the silane vapors was 30 minutes. The sample was not discolored. The material was highly water repellent. The material was somewhat weakened.

EXAMPLE IX

A sheet of bleached supercalendered Kraft paper having a moisture content of 9% was placed in a bell jar. The jar was evacuated, its pressure being reduced to approximately 3 Torr. A mixture of methylchlorosilanes of Example I at room temperature was introduced into the jar. After 60 seconds the saturated silane atmosphere was evacuated and dried air introduced into the jar. There was no odor of HCl on the sample. The sheet was placed in an oven at 300° F. for 60 seconds. The sheet was not discolored or embrittled. The sheet was highly water repellent.

EXAMPLE X

The same procedure as in Example IX was followed except that the material was white cotton percale. There was no degradation. The material was highly water repellent.

It is claimed:

1. A process for rendering a cellulosic material water repellent by treatment with vapors of lower alkyl silicon halide without the need of a neutralization step while retaining the strength characteristics of the material which consists essentially of contacting in a contact chamber at a contact chamber pressure of about 1 Torr to 16.7 psi a cellulosic material having a water content of up to about 10 weight percent with vapors of a lower alkyl silicon halide which reacts with hydroxyl groups to form a siloxane, said vapors being at a temperature of ambient room temperature to 180° F. and a concentration of about 0.5 volume percent up to the saturation of the contacting atmosphere, and a contact time of from 0.1 second up to 30 minutes, maintaining the concentration of lower alkyl silicon halide in the contacting atmosphere, the temperature of said lower alkyl silicon halide vapor, the pressure within said treating chamber, the temperature of the cellulosic material, and the contact time so that the cellulosic material contacted with the lower alkyl silicon halide is rendered water repellent and has a pH greater than 3.5.

2. The process of claim 1 wherein the water content of said cellulosic material is below about 2% by weight.

3. The process of claim 1 wherein the water content of said cellulosic material is 0 to about 1 weight percent.

4. The process of claim 1 wherein the water content of said cellulosic material is about 0 weight percent.

5. The process of claim 1 wherein the cellulosic material is paper.

6. The process of claim 1 wherein the cellulosic material is paper.

7. The process of claim 1 wherein the cellulosic material is a textile.

8. The process of claim 4 wherein the cellulosic material is a textile.

9. The process of claim 1 wherein the said cellulosic material is contacted with a mixture of vapors of the lower alkyl silicon halide and vapors of a solvent for the lower alkyl silicon halide which solvent is non-reactive with the lower alkyl silicon halide or the cellulosic material.

10. The process of claim 8 wherein the said cellulosic material is contacted with a mixture of vapors of the lower alkyl silicon halide and vapors of a solvent for the lower alkyl silicon halide which solvent is non-reactive with the lower alkyl silicon halide or the cellulosic material.

11. The process of claim 1 wherein the cellulosic material is removed from contact with the lower alkyl silicon halide and is heated to remove hydrogen halide from the cellulosic material prior to a substantial portion of said hydrogen halide being dissolved in water contained in the cellulosic material.

12. The process of claim 1 wherein the cellulosic material subjected to said contacting is below ambient temperature.

13. The process of claim 1 wherein the cellulosic material subjected to said contacting is substantially frozen.

14. The process of claim 13 wherein the cellulosic material is removed from contact with the lower alkyl silicon halide and is heated to remove hydrogen halide from the cellulosic material prior to a substantial portion of said hydrogen halide being dissolved in water contained in the cellulosic material.

15. The process of claim 1 wherein the contacting is conducted under subatmospheric pressure.

16. The process of claim 4 wherein the contacting is conducted under vacuum.

17. The process of claim 16 wherein the cellulosic material is removed from contact with the lower alkyl silicon halide and is heated to remove hydrogen halide from the cellulosic material prior to a substantial portion of said hydrogen halide being dissolved in water contained in the cellulosic material.

18. The process of claim 1 wherein said lower alkyl silicon halide comprises a methylchlorosilane or a mixture of methylchlorosilanes.

19. The process of claim 1 wherein said lower alkyl silicon halide comprises a methylchlorosilane or a mixture of methylchlorosilanes.

20. The process of claim 13 wherein said lower alkyl silicon halide comprises a methylchlorosilane or a mixture of methylchlorosilanes.

21. The process of claim 16 wherein said lower alkyl silicon halide comprises a methylchlorosilane or a mixture of methylchlorosilanes.

22. The process of claim 3 wherein the temperature of the vapors is ambient room temperature to 150° F., the temperature of the cellulosic material is frozen to ambient room temperature, the concentration of the vapors is 4 volume percent up to the saturation of the contacting atmosphere, the contact time is in excess of 7 seconds and the contact chamber pressure is 3 Torr to atmospheric pressure.

23. The process of claim 13 wherein the temperature of the vapors is ambient room temperature to 150° C., the concentration of the vapors is ½ volume % up to the saturation of the contacting atmosphere, the contact time is 0.1 to 30 seconds, and the contact chamber pressure is 3 Torr to atmospheric pressure.

24. The process of claim 15 wherein the temperature of the vapors is ambient room temperature to 150° C., the concentration of the vapors is ½ volume percent up to the saturation of the contacting atmosphere, the temperature of the paper is frozen to ambient room temperature and the contact time is 1 to 10 minutes.

* * * * *